US008248400B2

(12) United States Patent
Sampsell

(10) Patent No.: US 8,248,400 B2
(45) **Date of Patent: *Aug. 21, 2012**

(54) METHOD AND SYSTEM FOR UPDATING OF DISPLAYS SHOWING DETERMINISTIC CONTENT

(75) Inventor: Jeffrey B Sampsell, Pueblo West, CO (US)

(73) Assignee: QUALCOMM MEMS Technologies, Inc., San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/209,910

(22) Filed: Aug. 15, 2011

(65) Prior Publication Data

US 2011/0298815 A1 Dec. 8, 2011

Related U.S. Application Data

(62) Division of application No. 11/673,330, filed on Feb. 9, 2007, now Pat. No. 8,004,514.

(60) Provisional application No. 60/772,613, filed on Feb. 10, 2006.

(51) Int. Cl.
*G09G 5/00* (2006.01)

(52) U.S. Cl. ..... 345/212; 345/204; 345/211

(58) Field of Classification Search ..... 345/204–215, 345/690–698; 382/232, 236
See application file for complete search history.

(56) References Cited

U.S. PATENT DOCUMENTS

| | | | | |
|---|---|---|---|---|
| 4,367,924 A | | 1/1983 | Clark et al. | |
| 5,150,432 A | | 9/1992 | Ueno et al. | |
| 5,550,373 A | * | 8/1996 | Cole et al. | 250/338.1 |
| 5,565,921 A | | 10/1996 | Sasaki et al. | |
| 5,629,521 A | * | 5/1997 | Lee et al. | 250/338.1 |
| 5,977,945 A | | 11/1999 | Ohshima | |
| 6,252,991 B1 | | 6/2001 | Uchio et al. | |
| 6,385,386 B1 | | 5/2002 | Aotake | |
| 6,819,469 B1 | * | 11/2004 | Koba | 359/290 |
| 8,004,514 B2 | | 8/2011 | Sampsell | |
| 2002/0158878 A1 | | 10/2002 | Smirnov et al. | |
| 2005/0074140 A1 | | 4/2005 | Grasso et al. | |
| 2006/0132491 A1 | | 6/2006 | Riach et al. | |

FOREIGN PATENT DOCUMENTS

| | | |
|---|---|---|
| EP | 0 745 969 | 12/1996 |
| EP | 1 227 486 | 7/2002 |

OTHER PUBLICATIONS

Konstantinides, et al., Design of an MPEG-2 codec, IEEE Signal Processing Magazine, 19:4(32-41) Jul. 2002.
ISR and WO for PCT/US07/003590, filed Feb. 9, 2007.
IPRP for PCT/US07/003590, filed Feb. 9, 2007.
Office Action dated May 19, 2010 in U.S. Appl. No. 11/673,330.
Office Action dated Sep. 30, 2010 in U.S. Appl. No. 11/673,330.

* cited by examiner

*Primary Examiner* — Vijay Shankar
(74) *Attorney, Agent, or Firm* — Knobbe Martens Olson & Bear LLP

(57) ABSTRACT

A method and apparatus for displaying image data is disclosed. The method includes receiving one of a plurality of sets of stored image update data to be displayed on a display device, wherein each set corresponds to one image in a sequence of images and wherein the plurality of sets of image update data comprise information identifying pixels that change from a previous image in the sequence of images, wherein the display device comprises an array of bi-stable display elements. The method further includes updating a portion of the display device, the portion containing the pixels identified in the received set of stored image update data.

36 Claims, 11 Drawing Sheets

| | Column Output Signals | |
|---|---|---|
| | $+V_{bias}$ | $-V_{bias}$ |
| Row Output Signals 0 | Stable | Stable |
| $+\Delta V$ | Relax | Actuate |
| $-\Delta V$ | Actuate | Relax |

METHOD AND SYSTEM FOR UPDATING OF DISPLAYS SHOWING DETERMINISTIC CONTENT

CROSS REFERENCE TO RELATED APPLICATIONS

This application is a divisional of U.S. patent application Ser. No. 11/673,330, filed Feb. 9, 2007, which claims priority of U.S. Provisional Application No. 60/772,613, filed Feb. 10, 2006, both of which are hereby incorporated by reference in their entireties.

BACKGROUND

1. Field of the Invention

The field of the invention relates to microelectromechanical systems (MEMS).

2. Description of the Related Technology

Microelectromechanical systems (MEMS) include micro mechanical elements, actuators, and electronics. Micromechanical elements may be created using deposition, etching, and or other micromachining processes that etch away parts of substrates and/or deposited material layers or that add layers to form electrical and electromechanical devices. One type of MEMS device is called an interferometric modulator. As used herein, the term interferometric modulator or interferometric light modulator refers to a device that selectively absorbs and/or reflects light using the principles of optical interference. In certain embodiments, an interferometric modulator may comprise a pair of conductive plates, one or both of which may be transparent and/or reflective in whole or part and capable of relative motion upon application of an appropriate electrical signal. In a particular embodiment, one plate may comprise a stationary layer deposited on a substrate and the other plate may comprise a metallic membrane separated from the stationary layer by an air gap. As described herein in more detail, the position of one plate in relation to another can change the optical interference of light incident on the interferometric modulator. Such devices have a wide range of applications, and it would be beneficial in the art to utilize and/or modify the characteristics of these types of devices so that their features can be exploited in improving existing products and creating new products that have not yet been developed.

SUMMARY OF CERTAIN EMBODIMENTS

The system, method, and devices of the invention each have several aspects, no single one of which is solely responsible for its desirable attributes. Without limiting the scope of this invention, its more prominent features will now be discussed briefly. After considering this discussion, and particularly after reading the section entitled "Detailed Description of Certain Embodiments" one will understand how the features of this invention provide advantages over other display devices.

An embodiment provides a method of displaying image data. The method includes receiving image update data to be displayed on a display device comprising an array of bi-stable display elements, the image update data corresponding to a following image in a sequence of images and identifying pixels in the following image that differ from a preceding image in the sequence of images. The method further includes displaying the following image by changing a portion of the preceding image, wherein the portion includes the pixels identified in the image update data.

Another embodiment provides a method for storing a sequence of images to be displayed on a display device. The method includes having a preceding image in the sequence of images, calculating, for a following image subsequent to the preceding image, a following set of image update data identifying pixels that changed from the preceding image to the following image, and storing the following set of calculated image update data to a memory.

Another embodiment provides a system for displaying image data that includes a display comprising an array of bi-stable display elements, and a memory storing a plurality of sets of image update data corresponding to a plurality of images in a sequence of images and wherein the plurality of sets of image update data comprise information identifying pixels to be changed from a previous image in the sequence of images. The system further includes an array driver in electrical communication with the memory and the display, the array driver being configured to receive, from the memory, one of the stored set of image update data, and to update a portion of the display, the portion containing the pixels identified in the received set of image update data.

Another embodiment provides a system for displaying image data that includes a display and a memory storing a plurality of sets of image update data, each set corresponding to one image in a sequence of images and wherein the plurality of sets of image update data comprise information identifying pixels that change from a previous image in the sequence of images. The system further includes a frame buffer and a display controller in electrical communication with the memory and the frame buffer, the display controller being configured to receive one of the sets of image update data from the memory and to store the received set of image update data in the frame buffer. The system further includes an array driver in electrical communication with the frame buffer and the display, the array driver being configured to receive the frame buffer data and to update the display based on the received frame buffer data.

Another embodiment provides a method of displaying image data that includes identifying a next image state in a sequence of images to be displayed on a display device, receiving, at an array driver, a stored set of image update data corresponding to the identified next image state, wherein the received set of stored image update data is one of a plurality of sets of stored image update data, wherein the plurality of sets of stored image update data comprise information identifying pixels that change from another image in the sequence of images. The method further includes updating a portion of the display device, the portion containing the pixels identified in the received set of stored image update data.

Another embodiment provides an electronic device for displaying image data, where the electronic device is configured to receive one of a plurality of sets of stored image update data to be displayed on a display device, each set corresponding to one image in a sequence of images and wherein the plurality of sets of stored image update data comprise information identifying pixels that change from a previous image in the sequence of images. The electronic device is further configured to update a portion of the display device, the portion containing the pixels identified in the received set of stored image update data, wherein the display device comprises an array of bi-stable display elements.

BRIEF DESCRIPTION OF THE DRAWINGS

FIGS. 1 through 12 are not drawn to scale.

DETAILED DESCRIPTION OF CERTAIN EMBODIMENTS

Figure 1:
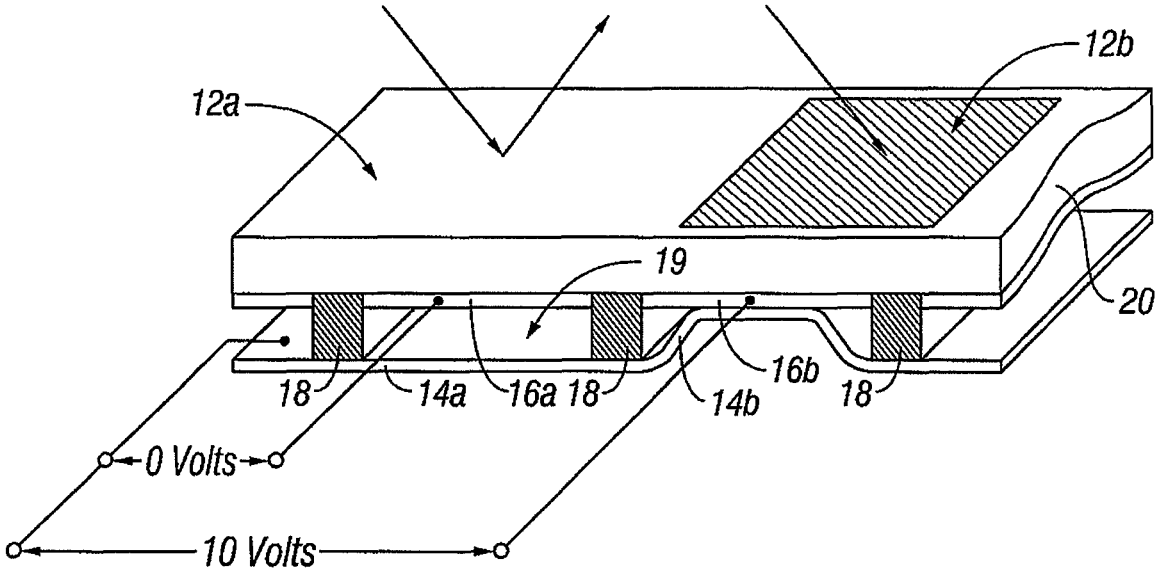
FIG. 1 is an isometric view depicting a portion of one embodiment of an interferometric modulator display in which a movable reflective layer of a first interferometric modulator is in a relaxed position and a movable reflective layer of a second interferometric modulator is in an actuated position.

The following detailed description is directed to certain specific embodiments of the invention. However, the invention can be embodied in a multitude of different ways. In this description, reference is made to the drawings wherein like parts are designated with like numerals throughout. As will be apparent from the following description, the embodiments may be implemented in any device that is configured to display an image, whether in motion (e.g., video) or stationary (e.g., still image), and whether textual or pictorial. More particularly, it is contemplated that the embodiments may be implemented in or associated with a variety of electronic devices such as, but not limited to, mobile telephones, wireless devices, personal data assistants (PDAs), hand-held or portable computers, GPS receivers/navigators, cameras, MP3 players, camcorders, game consoles, wrist watches, clocks, calculators, television monitors, flat panel displays, computer monitors, auto displays (e.g., odometer display, etc.), cockpit controls and/or displays, display of camera views (e.g., display of a rear view camera in a vehicle), electronic photographs, electronic billboards or signs, projectors, architectural structures, packaging, and aesthetic structures (e.g., display of images on a piece of jewelry). MEMS devices of similar structure to those described herein can also be used in non-display applications such as in electronic switching devices.

One type of display comprises an array of bi-stable display elements. Images rendered on an array of bi-stable elements are viewable for a long period of time without having to constantly refresh the display, and require relatively low power to maintain the displayed image. In such displays, a variety of refresh and update processes can be used that take advantage of the bi-stable display elements characteristics to decrease the power requirements of the display.

Due to the decreased power requirements afforded by bi-stable displays when used in conjunction with drivers and controllers designed for them, the power consumed by the processing of calculations for display updates may be a substantial portion of the total power requirements of a display device, even for a device with a display as simple as a that of a digital watch, for example. In one embodiment, a system is disclosed for creating and storing sets of image update data that may be received by a display device and directly displayed, with little or no calculating, to replicate an image sequence. In this embodiment, the stored sets of image update data comprise information identifying only those pixels in the display that change from a previous image in the sequence. In another embodiment, a system is disclosed for replicating and displaying the image sequence by using the stored image update data. Since the displaying device may not require a processor for calculating display updates, some power savings may be realized. In another embodiment, the display device includes a bi-stable display with drivers and/or controllers designed to update only the pixels identified as having changed, which may result in more power savings.

One interferometric modulator display embodiment comprising an interferometric MEMS display element is illustrated in FIG. 1. In these devices, the pixels are in either a bright or dark state. In the bright ("on" or "open") state, the display element reflects a large portion of incident visible light to a user. When in the dark ("off" or "closed") state, the display element reflects little incident visible light to the user. Depending on the embodiment, the light reflectance properties of the "on" and "off" states may be reversed. MEMS pixels can be configured to reflect predominantly at selected colors, allowing for a color display in addition to black and white.

FIG. 1 is an isometric view depicting two adjacent pixels in a series of pixels of a visual display, wherein each pixel comprises a MEMS interferometric modulator. In some embodiments, an interferometric modulator display comprises a row/column array of these interferometric modulators. Each interferometric modulator includes a pair of reflective layers positioned at a variable and controllable distance from each other to form a resonant optical cavity with at least one variable dimension. In one embodiment, one of the reflective layers may be moved between two positions. In the first position, referred to herein as the relaxed position, the movable reflective layer is positioned at a relatively large distance from a fixed partially reflective layer. In the second position, referred to herein as the actuated position, the movable reflective layer is positioned more closely adjacent to the partially reflective layer. Incident light that reflects from the two layers interferes constructively or destructively depending on the position of the movable reflective layer, producing either an overall reflective or non-reflective state for each pixel.

The depicted portion of the pixel array in FIG. 1 includes two adjacent interferometric modulators 12*a* and 12*b*. In the interferometric modulator 12*a* on the left, a movable reflective layer 14*a* is illustrated in a relaxed position at a predetermined distance from an optical stack 16*a*, which includes a partially reflective layer. In the interferometric modulator 12*b* on the right, the movable reflective layer 14*b* is illustrated in an actuated position adjacent to the optical stack 16*b*.

The optical stacks 16*a* and 16*b* (collectively referred to as optical stack 16), as referenced herein, typically comprise of several fused layers, which can include an electrode layer, such as indium tin oxide (ITO), a partially reflective layer, such as chromium, and a transparent dielectric. The optical stack 16 is thus electrically conductive, partially transparent and partially reflective, and may be fabricated, for example, by depositing one or more of the above layers onto a transparent substrate 20. The partially reflective layer can be formed from a variety of materials that are partially reflective such as various metals, semiconductors, and dielectrics. Some examples of suitable materials include oxides, nitrides, and fluorides. Other examples include germanium (Ge), nickel silicide (NiSi), molybdenum (Mo), titanium (Ti), tantalum (Ta), and platinum (Pt). The partially reflective layer can be formed of one or more layers of materials, and each of the layers can be formed of a single material or a combination of materials.

In some embodiments, the layers of the optical stack are patterned into parallel strips, and may form row electrodes in a display device as described further below. The movable reflective layers 14*a*, 14*b* may be formed as a series of parallel strips of a deposited metal layer or layers (orthogonal to the row electrodes of 16*a*, 16*b*) deposited on top of posts 18 and an intervening sacrificial material deposited between the posts 18. When the sacrificial material is etched away, the movable reflective layers 14*a*, 14*b* are separated from the optical stacks 16*a*, 16*b* by a defined gap 19. A highly conductive and reflective material such as aluminum may be used for the reflective layers 14, and these strips may form column electrodes in a display device.

With no applied voltage, the cavity 19 remains between the movable reflective layer 14*a* and optical stack 16*a*, with the movable reflective layer 14*a* in a mechanically relaxed state, as illustrated by the pixel 12*a* in FIG. 1. However, when a potential difference is applied to a selected row and column, the capacitor formed at the intersection of the row and column electrodes at the corresponding pixel becomes charged, and electrostatic forces pull the electrodes together. If the voltage is high enough, the movable reflective layer 14 is deformed and is forced against the optical stack 16. A dielectric layer (not illustrated in this Figure) within the optical stack 16 may prevent shorting and control the separation distance between layers 14 and 16, as illustrated by pixel 12*b* on the right in FIG. 1. The behavior is the same regardless of the polarity of the applied potential difference. In this way, row/column actuation that can control the reflective vs. non-reflective pixel states is analogous in many ways to that used in conventional LCD and other display technologies.

FIGS. 2 through 5 illustrate one exemplary process and system for using an array of interferometric modulators in a display application.

Figure 2:
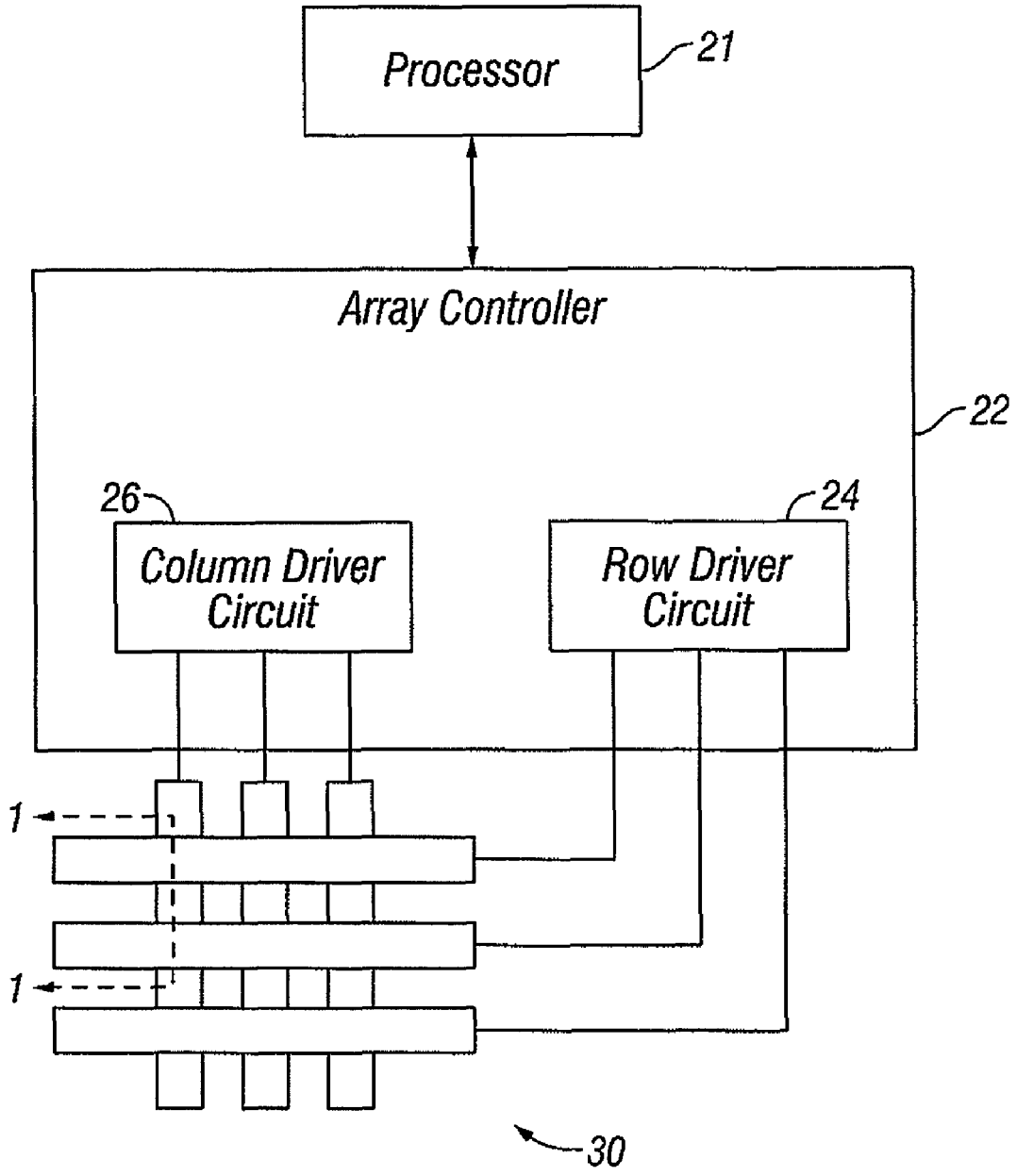
FIG. 2 is a system block diagram illustrating one embodiment of an electronic device incorporating a 3×3 interferometric modulator display.

FIG. 2 is a system block diagram illustrating one embodiment of an electronic device that may incorporate aspects of the invention. In the exemplary embodiment, the electronic device includes a processor 21 which may be any general purpose single- or multi-chip microprocessor such as an ARM, Pentium®, Pentium II®, Pentium III®, Pentium IV®, Pentium® Pro, an 8051, a MIPS®, a Power PC®, an ALPHA®, or any special purpose microprocessor such as a digital signal processor, microcontroller, or a programmable gate array. As is conventional in the art, the processor 21 may be configured to execute one or more software modules. In addition to executing an operating system, the processor may be configured to execute one or more software applications, including a web browser, a telephone application, an email program, or any other software application.

In one embodiment, the processor 21 is also configured to communicate with an array driver 22. In one embodiment, the array driver 22 includes a row driver circuit 24 and a column driver circuit 26 that provide signals to a display array or panel 30. The cross section of the array illustrated in FIG. 1 is shown by the lines 1-1 in FIG. 2. For MEMS interferometric modulators, the row/column actuation protocol may take advantage of a hysteresis property of these devices illustrated in FIG. 3. It may require, for example, a 10 volt potential difference to cause a movable layer to deform from the relaxed state to the actuated state. However, when the voltage is reduced from that value, the movable layer maintains its state as the voltage drops back below 10 volts. In the exemplary embodiment of FIG. 3, the movable layer does not relax completely until the voltage drops below 2 volts. There is thus a range of voltage, about 3 to 7 V in the example illustrated in FIG. 3, where there exists a window of applied voltage within which the device is stable in either the relaxed or actuated state. This is referred to herein as the "hysteresis window" or "stability window." For a display array having the hysteresis characteristics of FIG. 3, the row/column actuation protocol can be designed such that during row strobing, pixels in the strobed row that are to be actuated are exposed to a voltage difference of about 10 volts, and pixels that are to be relaxed are exposed to a voltage difference of close to zero volts. After the strobe, the pixels are exposed to a steady state voltage difference of about 5 volts such that they remain in whatever state the row strobe put them in. After being written, each pixel sees a potential difference within the "stability window" of 3-7 volts in this example. This feature makes the pixel design illustrated in FIG. 1 stable under the same applied voltage conditions in either an actuated or relaxed pre-existing state. Since each pixel of the interferometric modulator, whether in the actuated or relaxed state, is essentially a capacitor formed by the fixed and moving reflective layers, this stable state can be held at a voltage within the hysteresis window with almost no power dissipation. Essentially no current flows into the pixel if the applied potential is fixed.

In typical applications, a display frame may be created by asserting the set of column electrodes in accordance with the desired set of actuated pixels in the first row. A row pulse is then applied to the row 1 electrode, actuating the pixels corresponding to the asserted column lines. The asserted set of column electrodes is then changed to correspond to the desired set of actuated pixels in the second row. A pulse is then applied to the row 2 electrode, actuating the appropriate pixels in row 2 in accordance with the asserted column electrodes. The row 1 pixels are unaffected by the row 2 pulse, and remain in the state they were set to during the row 1 pulse. This may be repeated for the entire series of rows in a sequential fashion to produce the frame. Generally, the frames are refreshed and/or updated with new display data by continually repeating this process at some desired number of frames per second. A wide variety of protocols for driving row and column electrodes of pixel arrays to produce display frames are also well known and may be used in conjunction with the present invention.

Figures 3, 4:
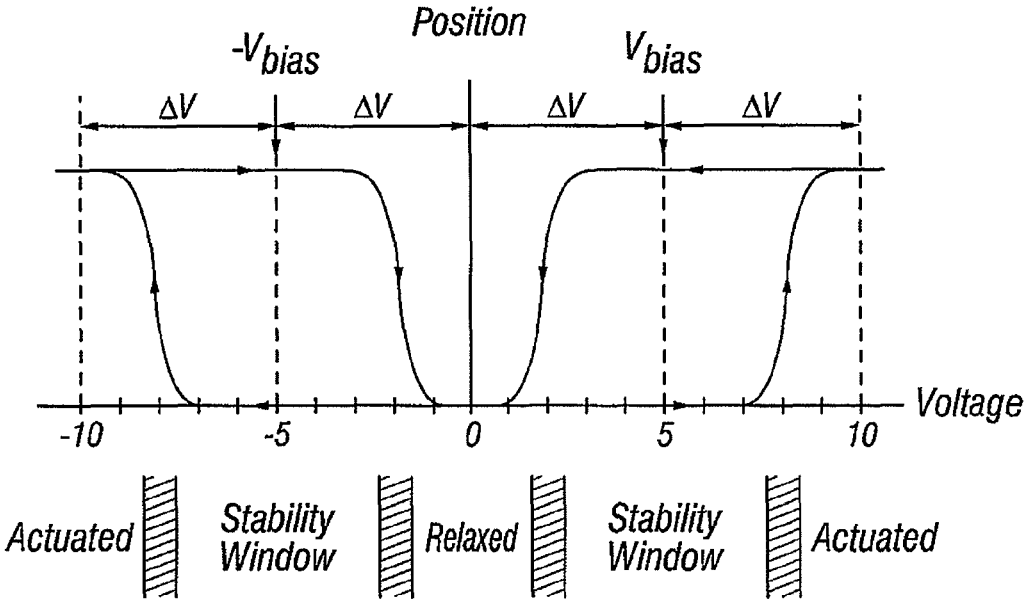
FIG. 3 is a diagram of movable mirror position versus applied voltage for one exemplary embodiment of an interferometric modulator of FIG. 1.
FIG. 4 is an illustration of a set of row and column voltages that may be used to drive an interferometric modulator display.

FIGS. 4 and 5 illustrate one possible actuation protocol for creating a display frame on the 3×3 array of FIG. 2. FIG. 4 illustrates a possible set of column and row voltage levels that may be used for pixels exhibiting the hysteresis curves of FIG. 3. In the FIG. 4 embodiment, actuating a pixel involves setting the appropriate column to $-V_{bias}$, and the appropriate row to $+\Delta V$, which may correspond to −5 volts and +5 volts respectively Relaxing the pixel is accomplished by setting the appropriate column to $+V_{bias}$, and the appropriate row to the same $+\Delta V$, producing a zero volt potential difference across the pixel. In those rows where the row voltage is held at zero volts, the pixels are stable in whatever state they were originally in, regardless of whether the column is at $+V_{bias}$, $-V_{bias}$. As is also illustrated in FIG. 4, it will be appreciated that voltages of opposite polarity than those described above can be used, e.g., actuating a pixel can involve setting the appropriate column to $+V_{bias}$, and the appropriate row to $-\Delta V$. In this embodiment, releasing the pixel is accomplished by setting the appropriate column to $-V_{bias}$, and the appropriate row to the same $-\Delta V$, producing a zero volt potential difference across the pixel.

Figure 5A:
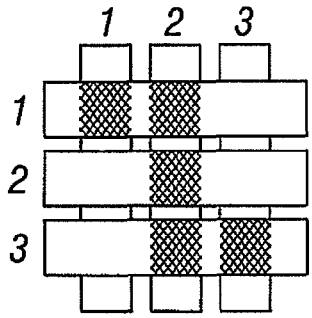
FIGS. 5A and 5B illustrate one exemplary timing diagram for row and column signals that may be used to write a frame of display data to the 3×3 interferometric modulator display of FIG. 2.
Figure 5B:
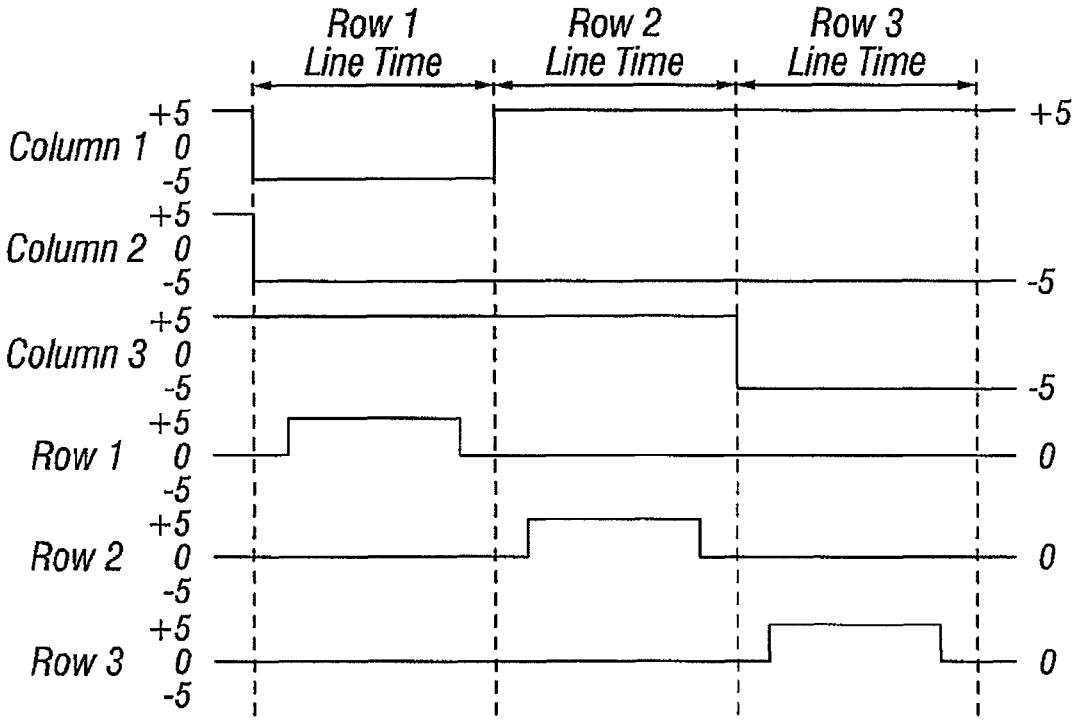

FIG. 5B is a timing diagram showing a series of row and column signals applied to the 3×3 array of FIG. 2 which will result in the display arrangement illustrated in FIG. 5A, where actuated pixels are non-reflective. Prior to writing the frame illustrated in FIG. 5A, the pixels can be in any state, and in this example, all the rows are at 0 volts, and all the columns are at +5 volts. With these applied voltages, all pixels are stable in their existing actuated or relaxed states.

In the FIG. 5A frame, pixels (1,1), (1,2), (2,2), (3,2) and (3,3) are actuated. To accomplish this, during a "line time" for row 1, columns 1 and 2 are set to −5 volts, and column 3 is set to +5 volts. This does not change the state of any pixels, because all the pixels remain in the 3-7 volt stability window. Row 1 is then strobed with a pulse that goes from 0, up to 5 volts, and back to zero. This actuates the (1,1) and (1,2) pixels and relaxes the (1,3) pixel. No other pixels in the array are affected. To set row 2 as desired, column 2 is set to −5 volts, and columns 1 and 3 are set to +5 volts. The same strobe applied to row 2 will then actuate pixel (2,2) and relax pixels (2,1) and (2,3). Again, no other pixels of the array are affected. Row 3 is similarly set by setting columns 2 and 3 to −5 volts, and column 1 to +5 volts. The row 3 strobe sets the row 3 pixels as shown in FIG. 5A. After writing the frame, the row potentials are zero, and the column potentials can remain at either +5 or −5 volts, and the display is then stable in the arrangement of FIG. 5A. It will be appreciated that the same procedure can be employed for arrays of dozens or hundreds of rows and columns. It will also be appreciated that the timing, sequence, and levels of voltages used to perform row and column actuation can be varied widely within the general principles outlined above, and the above example is exemplary only, and any actuation voltage method can be used with the systems and methods described herein.

Figure 6A:
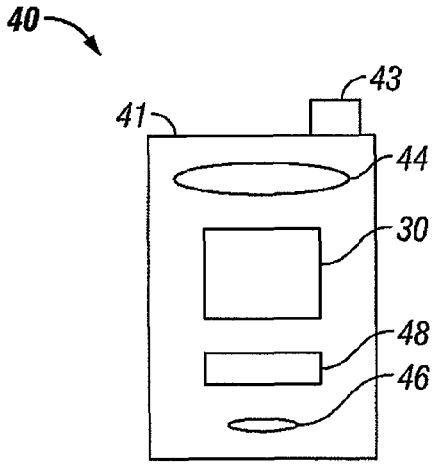
FIGS. 6A and 6B are system block diagrams illustrating an embodiment of a visual display device comprising a plurality of interferometric modulators.
Figure 6B:
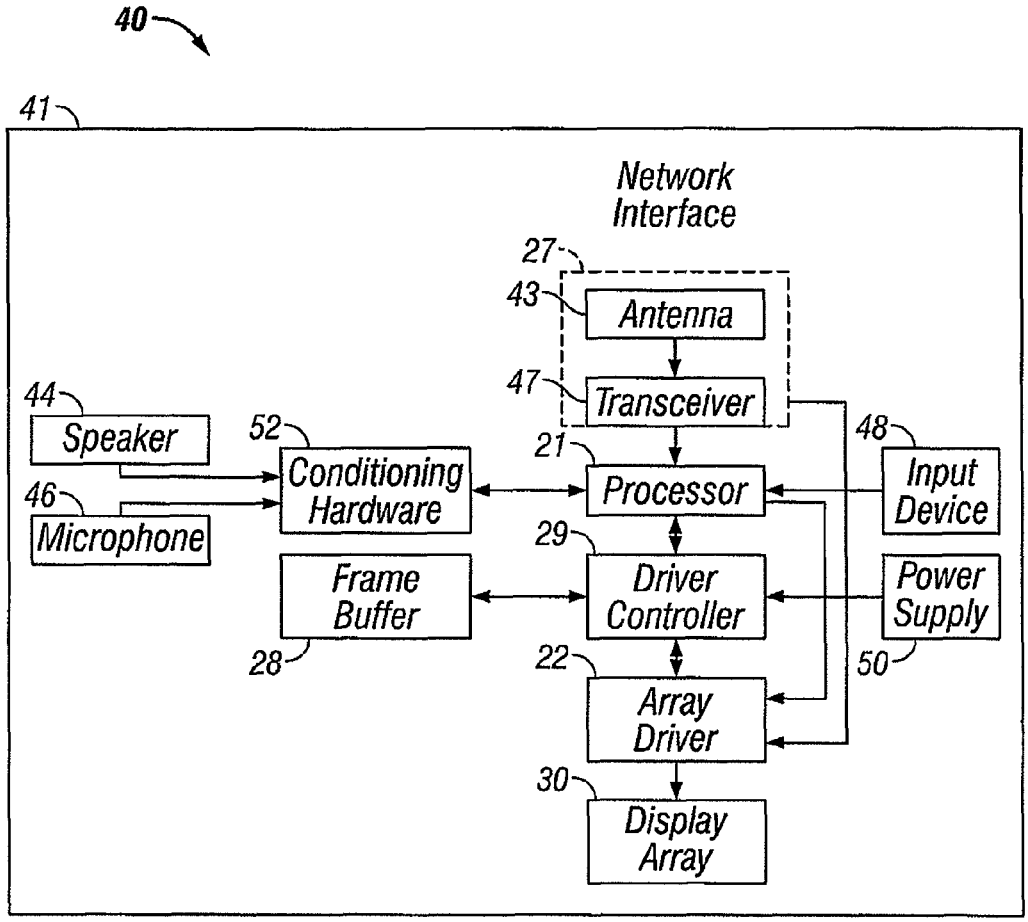

FIGS. 6A and 6B are system block diagrams illustrating an embodiment of a display device 40. The display device 40 can be, for example, a cellular or mobile telephone. However, the same components of display device 40 or slight variations thereof are also illustrative of various types of display devices such as televisions and portable media players.

The display device 40 includes a housing 41, a display 30, an antenna 43, a speaker 44, an input device 48, and a microphone 46. The housing 41 is generally formed from any of a variety of manufacturing processes as are well known to those of skill in the art, including injection molding, and vacuum forming. In addition, the housing 41 may be made from any of a variety of materials, including but not limited to plastic, metal, glass, rubber, and ceramic, or a combination thereof. In one embodiment the housing 41 includes removable portions (not shown) that may be interchanged with other removable portions of different color, or containing different logos, pictures, or symbols.

The display 30 of exemplary display device 40 may be any of a variety of displays, including a bi-stable display, as described herein. In other embodiments, the display 30 includes a flat-panel display, such as plasma, EL, OLED, STN LCD, or TFT LCD as described above, or a non-flat-panel display, such as a CRT or other tube device, as is well known to those of skill in the art. However, for purposes of describing the present embodiment, the display 30 includes an interferometric modulator display, as described herein.

The components of one embodiment of exemplary display device 40 are schematically illustrated in FIG. 6B. The illustrated exemplary display device 40 includes a housing 41 and can include additional components at least partially enclosed therein. For example, in one embodiment, the exemplary display device 40 includes a network interface 27 that includes an antenna 43 which is coupled to a transceiver 47. The transceiver 47 is connected to a processor 21, which is connected to conditioning hardware 52. The conditioning hardware 52 may be configured to condition a signal (e.g. filter a signal). The conditioning hardware 52 is connected to a speaker 45 and a microphone 46. The processor 21 is also connected to an input device 48 and a driver controller 29. The driver controller 29 is coupled to a frame buffer 28, and to an array driver 22, which in turn is coupled to a display array 30. A power supply 50 provides power to all components as required by the particular exemplary display device 40 design.

The network interface 27 includes the antenna 43 and the transceiver 47 so that the exemplary display device 40 can communicate with one ore more devices over a network. In one embodiment the network interface 27 may also have some processing capabilities to relieve requirements of the processor 21. The antenna 43 is any antenna known to those of skill in the art for transmitting and receiving signals. In one embodiment, the antenna transmits and receives RF signals according to the IEEE 802.11 standard, including IEEE 802.11(a), (b), or (g). In another embodiment, the antenna transmits and receives RF signals according to the BLUETOOTH standard. In the case of a cellular telephone, the antenna is designed to receive CDMA, GSM, AMPS or other known signals that are used to communicate within a wireless cell phone network. The transceiver 47 pre-processes the signals received from the antenna 43 so that they may be received by and further manipulated by the processor 21. The transceiver 47 also processes signals received from the processor 21 so that they may be transmitted from the exemplary display device 40 via the antenna 43.

In an alternative embodiment, the transceiver 47 can be replaced by a receiver. In yet another alternative embodiment, network interface 27 can be replaced by an image source, which can store or generate image data to be sent to the processor 21. For example, the image source can be a digital video disc (DVD) or a hard-disc drive that contains image data, or a software module that generates image data.

Processor 21 generally controls the overall operation of the exemplary display device 40. The processor 21 receives data, such as compressed image data from the network interface 27 or an image source, and processes the data into raw image data or into a format that is readily processed into raw image data. The processor 21 then sends the processed data to the driver controller 29 or to frame buffer 28 for storage. Raw data typically refers to the information that identifies the image characteristics at each location within an image. For example, such image characteristics can include color, saturation, and gray-scale level.

In one embodiment, the processor 21 includes a microcontroller, CPU, or logic unit to control operation of the exemplary display device 40. Conditioning hardware 52 generally includes amplifiers and filters for transmitting signals to the speaker 45, and for receiving signals from the microphone 46. Conditioning hardware 52 may be discrete components within the exemplary display device 40, or may be incorporated within the processor 21 or other components.

The driver controller 29 takes the raw image data generated by the processor 21 either directly from the processor 21 or from the frame buffer 28 and reformats the raw image data appropriately for high speed transmission to the array driver 22. Specifically, the driver controller 29 reformats the raw image data into a data flow having a raster-like format, such that it has a time order suitable for scanning across the display array 30. Then the driver controller 29 sends the formatted information to the array driver 22. Although a driver controller 29, such as a LCD controller, is often associated with the system processor 21 as a stand-alone Integrated Circuit (IC), such controllers may be implemented in many ways. They may be embedded in the processor 21 as hardware, embedded in the processor 21 as software, or fully integrated in hardware with the array driver 22.

Typically, the array driver 22 receives the formatted information from the driver controller 29 and reformats the video data into a parallel set of waveforms that are applied many times per second to the hundreds and sometimes thousands of leads coming from the display's x-y matrix of pixels.

In one embodiment, the driver controller 29, array driver 22, and display array 30 are appropriate for any of the types of displays described herein. For example, in one embodiment, driver controller 29 is a conventional display controller or a bi-stable display controller (e.g., an interferometric modulator controller). In another embodiment, array driver 22 is a conventional driver or a bi-stable display driver (e.g., an interferometric modulator display). In yet another embodiment, display array 30 is a typical display array or a bi-stable display array (e.g., a display including and array of interferometric modulators).

In one embodiment, a driver controller 29 is integrated with the array driver 22. Such an embodiment is common in highly integrated systems such as cellular phones, watches, and other small area displays. Specialized circuitry within such an integrated array driver 22 first determines which pixels and hence rows require refresh, and only selects those rows that have pixels that have changed to update. With such circuitry, particular rows can be addressed in non-sequential order, on a changing basis depending on image content. This embodiment has the advantage that since only the changed video data needs to be sent through the interface, data rates can be reduced between the processor 21 and the display array 30. Lowering the effective data rate required between processor 21 and array driver 22 improves power consumption, noise immunity and electromagnetic interference issues for the system.

The input device 48 allows a user to control the operation of the exemplary display device 40. In one embodiment, input device 48 includes a keypad, such as a QWERTY keyboard or a telephone keypad, a button, a switch, a touch-sensitive screen, a pressure- or heat-sensitive membrane. In one embodiment, the microphone 46 is an input device for the exemplary display device 40. When the microphone 46 is used to input data to the device, voice commands may be provided by a user for controlling operations of the exemplary display device 40.

Power supply 50 can include a variety of energy storage devices as are well known in the art. For example, in one embodiment, power supply 50 is a rechargeable battery, such as a nickel-cadmium battery or a lithium ion battery. In another embodiment, power supply 50 is a renewable energy source, a capacitor, or a solar cell, including a plastic solar cell, and solar-cell paint. In another embodiment, power supply 50 is configured to receive power from a wall outlet.

In some implementations control programmability resides, as described above, in a driver controller which can be located in several places in the electronic display system. In some cases control programmability resides in the array driver 22. Those of skill in the art will recognize that the above-described optimization may be implemented in any number of hardware and/or software components and in various configurations.

Figure 7A:
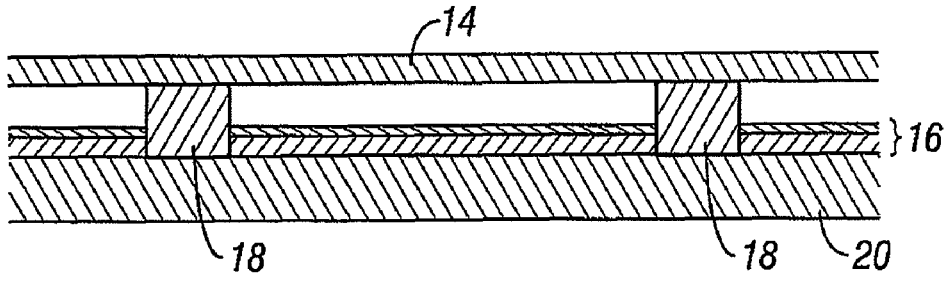
FIG. 7A is a cross section of the device of FIG. 1.
Figure 7B:
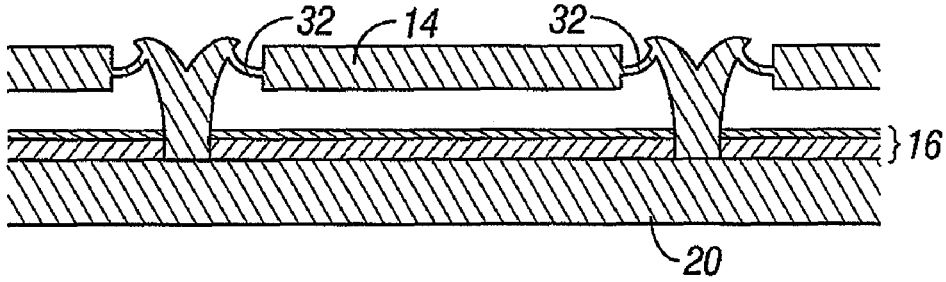
FIG. 7B is a cross section of an alternative embodiment of an interferometric modulator.
Figure 7C:
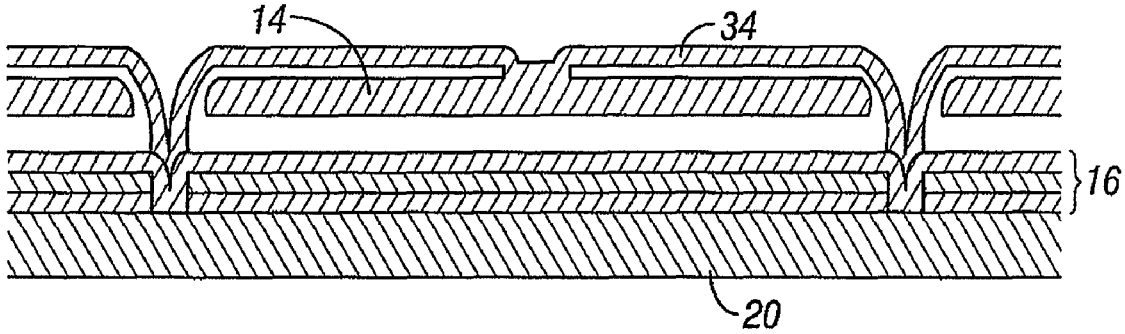
FIG. 7C is a cross section of another alternative embodiment of an interferometric modulator.
Figure 7D:
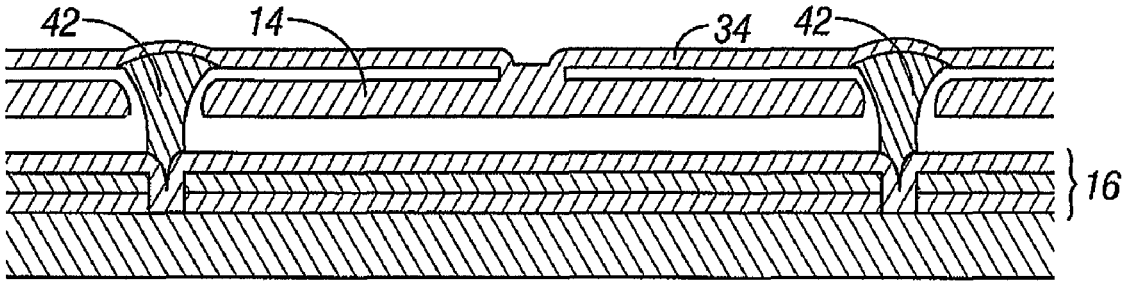
FIG. 7D is a cross section of yet another alternative embodiment of an interferometric modulator.
Figure 7E:
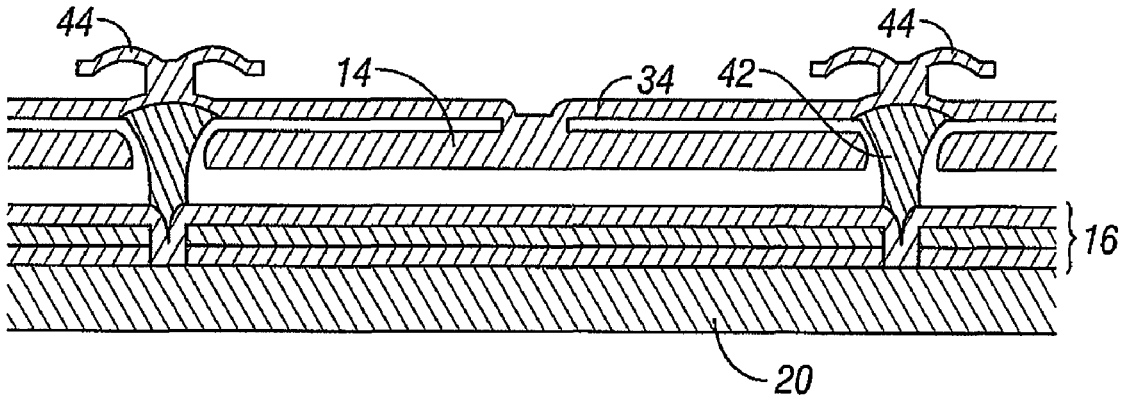
FIG. 7E is a cross section of an additional alternative embodiment of an interferometric modulator.

The details of the structure of interferometric modulators that operate in accordance with the principles set forth above may vary widely. For example, FIGS. 7A-7E illustrate five different embodiments of the movable reflective layer 14 and its supporting structures. FIG. 7A is a cross section of the embodiment of FIG. 1, where a strip of metal material 14 is deposited on orthogonally extending supports 18. In FIG. 7B, the moveable reflective layer 14 is attached to supports at the corners only, on tethers 32. In FIG. 7C, the moveable reflective layer 14 is suspended from a deformable layer 34, which may comprise a flexible metal. The deformable layer 34 connects, directly or indirectly, to the substrate 20 around the perimeter of the deformable layer 34. These connections are herein referred to as support posts. The embodiment illustrated in FIG. 7D has support post plugs 42 upon which the deformable layer 34 rests. The movable reflective layer 14 remains suspended over the cavity, as in FIGS. 7A-7C, but the deformable layer 34 does not form the support posts by filling holes between the deformable layer 34 and the optical stack 16. Rather, the support posts are formed of a planarization material, which is used to form support post plugs 42. The embodiment illustrated in FIG. 7E is based on the embodiment shown in FIG. 7D, but may also be adapted to work with any of the embodiments illustrated in FIGS. 7A-7C as well as additional embodiments not shown. In the embodiment shown in FIG. 7E, an extra layer of metal or other conductive material has been used to form a bus structure 44. This allows signal routing along the back of the interferometric modulators, eliminating a number of electrodes that may otherwise have had to be formed on the substrate 20.

In embodiments such as those shown in FIG. 7, the interferometric modulators function as direct-view devices, in which images are viewed from the front side of the transparent substrate 20, the side opposite to that upon which the modulator is arranged. In these embodiments, the reflective layer 14 optically shields the portions of the interferometric modulator on the side of the reflective layer opposite the substrate 20, including the deformable layer 34. This allows the shielded areas to be configured and operated upon without negatively affecting the image quality. Such shielding allows the bus structure 44 in FIG. 7E, which provides the ability to separate the optical properties of the modulator from the electromechanical properties of the modulator, such as addressing and the movements that result from that addressing. This separable modulator architecture allows the structural design and materials used for the electromechanical aspects and the optical aspects of the modulator to be selected and to function independently of each other. Moreover, the embodiments shown in FIGS. 7C-7E have additional benefits deriving from the decoupling of the optical properties of the reflective layer 14 from its mechanical properties, which are carried out by the deformable layer 34. This allows the structural design and materials used for the reflective layer 14 to be optimized with respect to the optical properties, and the structural design and materials used for the deformable layer 34 to be optimized with respect to desired mechanical properties.

In one embodiment, a system is provided for creating and storing sets of predetermined image update data that may be received by a display device and directly displayed, with little or no calculating, to replicate a deterministic image sequence. In this embodiment, the stored sets of image update data comprise information identifying only those pixels in the display that change from a previous image in the sequence. In another embodiment, a system is disclosed for replicating and displaying the deterministic image sequence on a display device by using the stored image update data. Since the displaying device may not be required to calculate display updates, power savings may be realized. In another embodiment, the display device includes a bi-stable display with drivers and/or controllers designed to update only the pixels identified as having changed, which may result in more power savings. In one embodiment the deterministic image sequence being displayed has a predetermined progression of a plurality of discrete states. Image update data can be stored for each of those states. Alternatively, the update information may be determined dynamically for multiple possible future states based upon the current state information.

In one embodiment, a processor may control the overall process flow for displaying the image sequence, including memory transfer of update data to a controller(s) and/or a driver(s), with the controller(s) and/or the driver(s) performing the actual update of the display device. In another embodiment, the controller(s) and/or the driver(s) may be "dumb" devices, e.g., the processor fetches and forwards the data to be displayed by the controller and/or driver. In yet another embodiment, the controller(s) and/or the driver(s) may be designed to perform the necessary identification, fetching and updating of the display device with the image sequence, without the processor.

Figure 8:
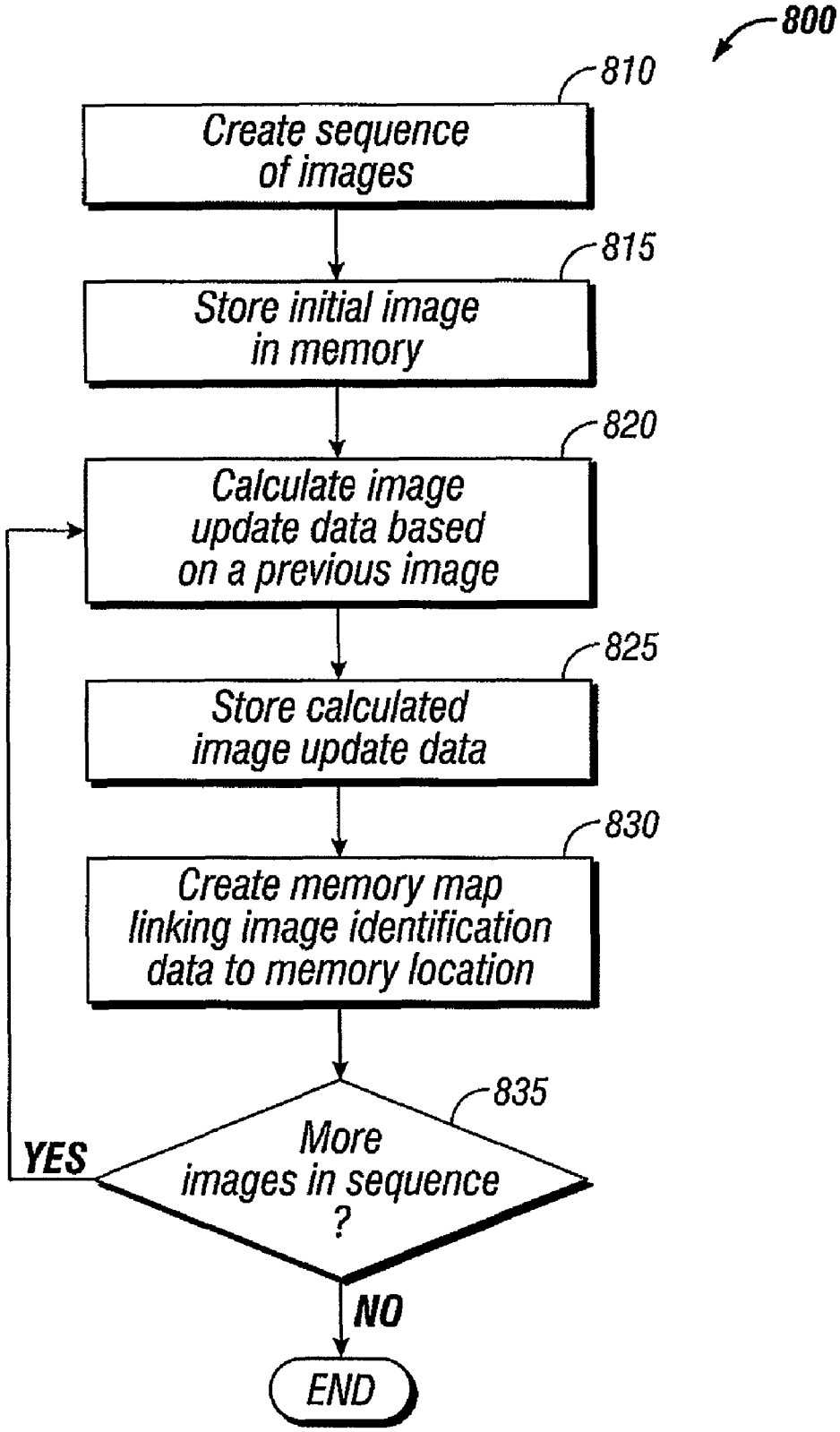
FIG. 8 is a flowchart illustrating an embodiment of a process for creating and storing an image sequence.

An embodiment of process flow is illustrated in FIG. 8, which shows a flowchart of a process for creating and storing an image sequence. In one embodiment, the process 800 may be performed offline and stored into memory of display device 40 in a manufacturing process for making the display device 40. The memory for storing the image sequence may be included in various components of the display device 40 such as, for example, the array driver 22, the driver controller 29 (where the driver controller 29 may be a display controller as discussed above in reference to FIG. 6B), and the frame buffer 28. In another embodiment, the process 800 may be performed on, e.g., a personal computer with a processor where the created image sequence and any necessary data for displaying the sequence, is stored on a memory module of the display device 40. In another embodiment, the process 800 may be performed on a display device 40 in order to replicate a video sequence being downloaded to the display device 40, where a source of the video sequence may be, e.g., a server, a video camera, or a memory storage device.

With reference to FIGS. 6 and 8, process 800 begins with creating a sequence of images at step 810, the sequence depicting a deterministic display progression such as the examples discussed below in reference to FIG. 10. Creating a sequence of images at step 810 may be accomplished using graphics design software, many of which are known to those of skill in the art. The sequence, in one embodiment, may be one of many sequences that replicate different modes, e.g. an analog watch, a digital watch, and a stopwatch mode, discussed below, which may all be displayed on the same device. In another embodiment, the sequence may represent a display device 40 responding to a user input command such as pushing input device 48. A user button push, for example, may command the display sequence being displayed currently, to be switched to another mode or state (this may result in a full update of the display or a small update, depending on the embodiment), e.g. switching from analog watch mode to digital watch or stopwatch mode. Process 800 may be used as many times as needed to create display sequences at step 810 that replicate an entire user interface design including user experiences such as menu inputs, mode changes, programming of various display states and others. In one embodiment, a portion of the frame, e.g., a sub-frame or window, may be the object of the display being updated in the image sequence. Other embodiments of sequences that can be created at step 810 will be apparent to those of skill in the art.

After a sequence of images has been created at step 810, process 800 continues at step 815 where an initial image in the sequence is stored into memory that may be accessible by display device 40. In one embodiment, the initial image may comprise a complete frame (or sub-frame) containing the data needed to display a complete image. In this embodiment, the display sequence may represent a new mode being started or a new state being instantiated on the display array 30. In another embodiment, the initial image may comprise a blank frame (all pixels on or off) with the frame being completed by the image sequence updates calculated in step 820. In this way, a gradual refresh of the display may be accomplished. In another embodiment the initial image may comprise a region of the frame such as a row portion or column portion of the frame.

After the initial frame is stored in step 815, process 800 continues at step 820 where image update data is calculated. Image update data is calculated such that the update data comprises changes from a previous image state in the sequence. In one embodiment, a display device targeted by the image sequence is a bi-stable display comprising an array of bi-stable display elements, e.g. an array of interferometric modulators. Images rendered on an array of bi-stable elements are viewable for a long period of time without having to constantly refresh the display, and require relatively low power to maintain the displayed image. By updating the bi-stable display using data comprising changes from a previous (or currently displayed) image state, drivers and/or controllers may be designed to update only the bi-stable elements that have changed, thereby saving power over refreshing the entire display. In these devices, the pixels may be in either a bright or dark state. In the bright ("on" or "open") state, the display element reflects a large portion of incident visible light to a user. When in the dark ("off" or "closed") state, the display element reflects little incident visible light to the user. Pixels may be black and white or color, as discussed above.

In one embodiment, the calculated image update data comprises a pixel change indicator for each pixel in the frame or subframe being updated, e.g. a single bit where a zero represents no change and a one represents a change from an open state to a closed state or from the closed state to the open state (multiple bit pixel change indicators may also be utilized for bi-stable display elements having more than two states, such as states not completely opened or closed but somewhere in between). An example of this embodiment is a row by row (or column by column) update of the pixels where the pixels indicated as having changed from the current state may be the only pixels updated by the controller and/or driver updating the display. For example, if each row contains 128 pixels, then the image update data for each row comprises 128 zeroes or ones where ones indicate a change from the previous state and zeroes indicate no change from the previous state. In another embodiment, the calculated image update data further comprises an indicator of which portion of the screen is being updated with the pixel change indicators. In another embodiment, image update data comprises an identifier of which individual pixel or group of pixels (e.g., a row portion or column portion or window of pixels) is indicated to have changed by the image update data. The image update data may further comprise pixel value data indicating the new data to be written to each pixel in the identified group of pixels. Such pixel and/or pixel group identifiers may be a pixel number, row/pixel number pairs, column/pixel number pairs, window coordinates and other identifiers that will be apparent to those of skill in the art. The pixel value data may comprise a zero to indicate a closed state, or a one to indicate an open state.

Since the image update data identifies which pixels change from a previous image state, the controller and/or driver updating the display may have very few pixels to change, thereby conserving power. An illustrative example is an analog watch face such as that shown in FIG. 10*a* and discussed below. Referencing FIG. 10*a*, if a new image is updated every second in order to track the movement of the fastest moving object in the display, i.e., second hand 515, then only the pixels where the second hand 515 is currently and the pixels where the second hand 515 will be, one second later, need to be changed (as well as any pixels changed by the relatively small rotation of minute hand 505, hour hand 510 and a change in date window 520). Other pixels might change due to one of the hands passing over the date window 520, or one of the other hands, where the display may depict, e.g., one of the hands passing in front of the display window or in front of one of the other hands.

After calculating the image update data at step 820, the image update data is stored into memory at step 825. In one embodiment, the image update data is stored into memory of the display device 40. In addition to storing the image update data in step 825, optional step 830 may create a memory map linking the image update data to a memory location where the image update data is stored. If the sequence of images being stored is a simple sequential set of image state updates, then a memory map may not be necessary. If different display modes, input responses or multiple sequence paths are possible, then a memory map may be useful. Different display modes may each comprise one or more deterministic sequences, where each sequence may be made up of multiple deterministic states. A memory map may contain state information such that a display device can identify a set of image update data (or multiple sets of image update data in cases where multiple image sequence paths are possible, see discussion referencing FIG. 10*d* below) to be displayed next based on a current state that the display device is in. Such state information may include the current state and the next state that follows, where the next state may be multiple states depending on whether images are being updated temporally, due to input commands, or due to non-temporal updates such as geographic movement, for example. In one embodiment, the image update data that is stored in step 825 may be compressed using data compression, e.g., any of several run length encoding schemes such as Huffman coding, thereby conserving memory space.

If there are more images to calculate image update for, and to store calculated image update data for, the decision block 835 will repeat steps 820, 825 and 830 until the image sequence is complete. Steps 820 through 835 may be repeated until all possible image state updates are completed. Image state updates may include image sequence paths dictated by user inputs, user programming options such as menu options, temporal interrupts such as updates every one-hundredth of a second or every tenth of a second, etc., and non-temporal interrupts such as geographic movement interrupt commands discussed below and illustrated in FIG. 10*d*. Process 800 may be repeated for all possible image sequence scenarios designed to be displayed on the display device 40. The image data sequences created by process 800 may be software that is downloadable to the display device 40. In one embodiment, the image sequences may be downloaded to the display device 40 as a service.

In one embodiment, process 800 may be performed in display device 40 utilizing e.g., processor 21 for performing some or all of steps 810 through 835, thereby calculating and storing the image update data and/or memory map into memory connected to display device 40. Processor 21 could then perform process 900, shown in FIG. 9 and discussed in detail below, to display the created and stored sequence if and when it is needed another time. One example of this embodiment is a watch display, where image update data may be created and calculated in a first pass and stored in memory. After being stored in memory, the image update data may be used to repeat the image sequence every twelve hours (or twenty-four hours in a military time mode). Depending on the embodiment, selected steps of process 800 illustrated in FIG. 8 may be removed, added or rearranged.

Figure 9:
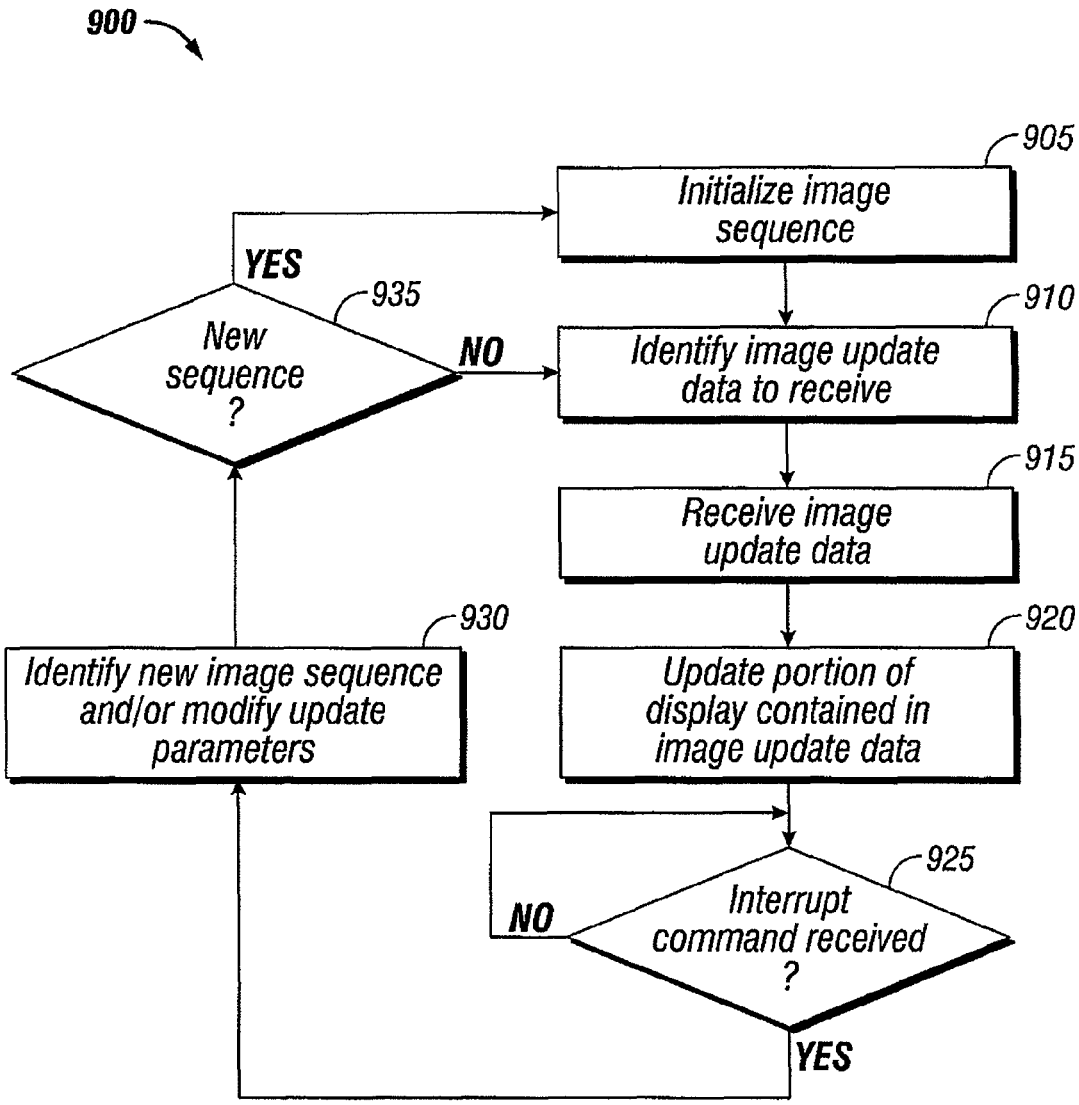
FIG. 9 is a flowchart illustrating an embodiment of a process for displaying an image sequence.

FIG. 9 is a flowchart illustrating an embodiment of a process for displaying an image sequence that was created using the process 800. Process 900 may be performed on the display device 40. In one embodiment, display device 40 includes a memory source (not shown in FIG. 6*b*) containing the data created and stored using the process 800. With reference to FIGS. 6 and 9, process 900 begins at step 905 where an image sequence to be displayed is initialized. In one embodiment, initialization may be started by turning on the display device 40, thereby initiating a boot process. The boot process may control the order in which modules are powered up and when interrupts may be issued. Interrupts may be prohibited by the boot process until all necessary components are powered up and able to handle the interrupts. After the boot process is complete, interrupt commands, e.g., user inputs and others, may be handled. In another embodiment, initialization may be performed after a user input, e.g., a user input on input device 48. User inputs and the need for sequence initialization due to user inputs, and other interrupt commands, will be discussed in more detail below with respect to receiving interrupt commands at decision block 925. Initialization may comprise receiving a memory address stored in, e.g., ROM that points to a start of a sequence of images in memory, the memory address being received at processor 21, driver controller 29 and/or array driver 22, depending on the embodiment. The memory address may point to an initial image in the sequence of images such as was created using, e.g., process 800 at step 815. Initialization may also include a driver, a controller or a processor setting display parameters for the sequence to commanded or default values. Display parameters may include parameters such as, display update rate, mode indicators, display format and others. In one embodiment, the initial image comprises a complete frame (or subframe) containing the data needed to display a complete image. In this embodiment, the display sequence may represent a new mode being started on the display. In another aspect of this embodiment, the initial image may comprise a blank frame (all pixels on or off) with the frame being updated in the image sequence updates received in step 915. In this way, a gradual refresh of the display may be accomplished. In another embodiment the initial image may comprise a region of the frame such as a row portion or column portion of the frame.

After initialization, process 900 continues at step 910 where the image update data to be received in step 915 is identified. Identifying the image update data may comprise setting a pointer in driver controller 29 and/or array driver 22 thereby locating the image update data pointed to by the memory address received in initialization step 905. In one embodiment, identifying the image update data comprises advancing a pointer in driver controller 29 and/or array driver 22 to point to the next set of image update data in the sequence currently being displayed by process 900. In another embodiment, a memory address identifying a memory space containing the identified set of image update data to be received, is received from memory. The memory address may be part of a memory map such as, e.g., a memory map created at step 830 of process 800, the memory map comprising data indicating that the image update data stored at the received memory address corresponds to the identified set of image update data to be received. The memory map may contain state information such that a display device may identify a set of image update data (or multiple sets of image update data in cases where multiple image sequence paths are possible, see discussion referencing FIG. 10*d* below) to be displayed next based on the current state that the display device is in. Such state information may include the current state and the next state that follows, where the next state may be multiple states depending on whether images are being updated temporally, due to input commands, or due to non-temporal updates such as geographic movement, for example. The acts of step 910 may be performed by processor 21, driver controller 29 and/or array driver 22. Other embodiments of identifying image update data at step 910 will be discussed below in reference to interrupt commands received at decision block 925, where interrupt commands may entail identifying a new sequence and/or modifying update parameters at step 930.

Process 900 continues at step 915, where the image update data identified at step 910 is received. The acts of step 915 may be performed by processor 21, driver controller 29 and/or array driver 22. In one embodiment, processor 21 receives the image update data from network interface 27, where network interface 27 may be replaced by an image source as discussed above. In another embodiment, driver controller 29 or an integrated driver controller 29/array driver 22 receives the image update data directly. The image update data comprises information identifying pixels that change from an image currently being displayed on a display device such as, e.g., display array 30. In other words, the image update data corresponding to a following image in a sequence of images identifies pixels in the following image that differ from the pixels of a preceding image (e.g., the one currently being displayed) in the sequence of images. In one embodiment, the display device is a bi-stable display comprising an array of bi-stable display elements, e.g. an array of interferometric modulators.

In one embodiment, the image update data received at step 915 comprises a pixel change indicator for each pixel in the frame or subframe being updated, e.g. a single bit where a zero represents no change and a one represents a change from an open state to a closed state or from the closed state to the open state (multiple bit pixel change indicators may also be utilized for bi-stable display elements having more than two states, such as states not completely opened or closed but somewhere in between). In another embodiment, image update data comprises an identifier of which individual pixel or group of pixels (e.g., a row portion or column portion or window of pixels) is indicated to have changed by the image update data. The image update data may further comprise pixel value data indicating the new data to be written to each pixel in the identified group of pixels. Such pixel and/or pixel group identifiers may be a pixel number, row/pixel number pairs, column/pixel number pairs, window coordinates and other identifiers that will be apparent to those of skill in the art. The pixel value data may comprise a zero to indicate a closed state, or a one to indicate an open state. The image update data may identify fewer than all the pixels of the following image to be changed from the preceding image. The image update data may exclude identifying pixels in the following image that do not change from the preceding image. The image update data may comprise changes from an immediately preceding image or from a preceding image where an intermediate image is located between the preceding image and the following image.

In one embodiment, the received image update data is in a compressed form such as, run length encoded, for example. In the case of run length encoded update data, a decoder may be used to run length decode the encoded data, thereby converting it to a format that may be used by array driver 22, and/or driver controller 29.

Process 900 continues to step 920, where array driver 22 updates the display array 30. In one embodiment, display device 30 is a bi-stable display comprising an array of bi-stable display elements, e.g. an array of interferometric modulators. By updating the bi-stable display using data comprising changes from a preceding (or the currently displayed) image, drivers and/or controllers may be designed to update only the bi-stable elements of the portion of the preceding image that have changed, thereby saving power over refreshing the entire display. Any bi-stable display elements for which update data is not received may be maintained in the state that they are in during the change from the preceding image to the following image. Array driver 22 may be configured to receive the image update data at step 915 and change only the identified pixels using many protocols, such as, e.g., the actuation protocol discussed above with respect to FIGS. 4 and 5.

Decision block 925 checks for interrupt commands. An interrupt command may be any kind of event that causes the process 900 to display another image in the sequence of images being displayed, or to display a new sequence of images, or to modify the way in which future images are displayed. In one embodiment, steps 910, 915 and 920 are repeated at a fixed display rate due to receiving interrupt commands at the fixed display rate from a timing circuit generating a pulse about every second. This type of embodiment may be used for a watch display that has only one mode, e.g., the analog display watch shown in FIG. 10*a* where updates are made every second, for example. However, by receiving other types of interrupt commands at decision block 925, many more types of displays may be replicated. Interrupt commands may be received by processor 21, driver controller 29, array driver 22 or an integrated driver controller/array driver. If no interrupt is received, decision block 925 may be repeated until an interrupt is received, at which point, process 900 continues to step 930.

The interrupts received at decision block 925 may be temporal interrupts, user input interrupts, interrupts triggered by an event such as the user moving a distance above a threshold (as in the GPS navigation display shown in FIG. 10*d* and discussed below), and others. The actions taken at step 930 will depend on the type of interrupt command. The acts of step 930 may be performed by processor 21, driver controller 29 and/or array driver 22. The acts of decision block 925 may be performed by processor 21, driver controller 29 and/or array driver 22. Several embodiments of interrupt command types will now be discussed.

In one embodiment, the interrupt command comprises a temporal interrupt received at decision block 925. A timer may be used to send an interrupt command at a fixed (or variable, or even random) time step. Actions taken at step 930 in response to a temporal interrupt command may depend on how the image sequence data was derived. If the stored image update data corresponds to image states updated at about the same time step as the interrupt command, then no action may be needed at step 930 and identifying the image update data at step 910 may comprise advancing an address pointer to point to the next state which corresponds to the next set of image update data in the sequence currently being displayed by process 900. If however, the stored image update time step is smaller than the interrupt command time period, then step 930 may identify that the next image state to be displayed may require several image updates be combined to form an aggregate set of image update data at step 910. For example, if the stored data is derived at one-tenth second increments, and a temporal interrupt command requests updates only every second, then ten image update data sets may be combined at step 910 to form the aggregate image update data set for updating display array 30 every second as commanded. If the stored image update time step is larger than the temporal interrupt command time period, then steps 910, 915 and 920 may be skipped until a time period has passed such that a temporal interrupt command is received that is about the same time increment as that of the next stored image update data set.

In another embodiment, a user input device 48 may be actuated resulting in the received interrupt command at decision block 925. In one example, the user input interrupt command may result in a new image sequence state being identified at step 930, in which case, the decision block 935 directs the process 900 to step 905 to initialize the new sequence corresponding to the newly identified state. The new sequence state may be a replacement for the current sequence state, in which case the entire display may require updating and the current image sequence may no longer be updated. The new sequence state may also be a sub-frame or window added within the existing image while maintaining the current image sequence, in which case step 930 identifies the new sequence to be added, decision block 935 directs the flow to step 905 where the new sequence is initialized. In this case, the current image sequence state is maintained and both the new sequence (e.g., the sub-frame or window) image update data and the old sequence image update data are identified at step 910, received at step 915 and the display updated at step 920.

In addition to starting a new sequence, a user input interrupt command may also require a modification of update parameters at step 930. Such parameters may be the temporal rate at which temporal interrupt commands (indicating when to advance to the next image state) are received, the position of windows within the display area, and other parameters. If a user input modifies the rate at which images are updated to the next state, then actions taken at step 930 may comprise modifying a display parameter controlling the display rate, and actions taken at step 910 may comprise combining images to form aggregate images, or skipping updates of images in the current sequence, as discussed above, resulting in the newly commanded display rate. Optionally, there may be separate image sequences derived for the new display rate and step 930 may identify the new image sequence state and decision block 935 may direct the process to step 905. The acts of decision block 935 may be performed by processor 21, driver controller 29 and/or array driver 22. Depending on the embodiment, selected steps of process 900 illustrated in FIG. 9 may be removed, added or rearranged.

Figure 10A:
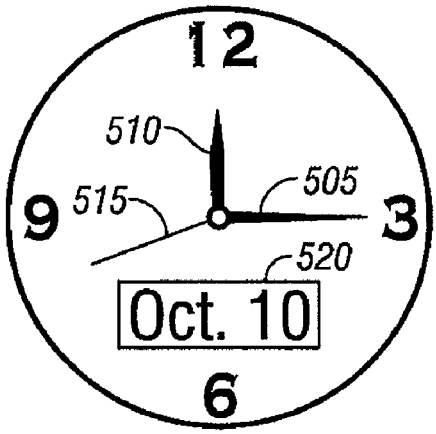
FIG. 10*a* illustrates an embodiment of a display device displaying an image representing an analog watch face.
Figure 10B:
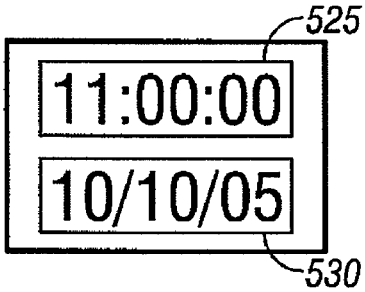
FIG. 10*b* illustrates an embodiment of a display device displaying an image representing a digital watch face.
Figure 10C:
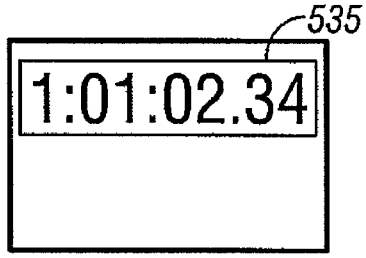
FIG. 10*c* illustrates an embodiment of a display device displaying an image representing a digital watch face in stopwatch mode.
Figure 10D:
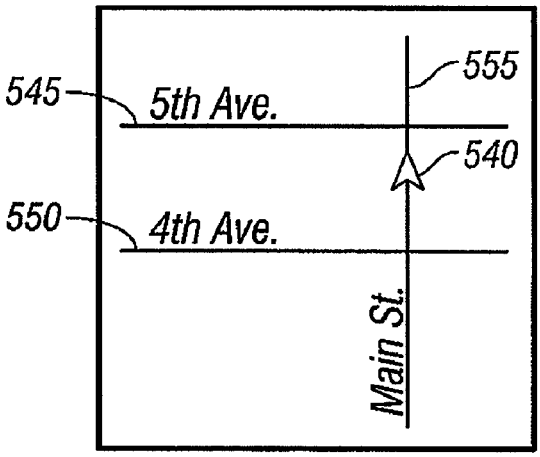
FIG. 10*d* illustrates an embodiment of a display device displaying an image of a map/navigation device.

In another embodiment, the interrupt command is a non-temporal interrupt, such as one triggered by a displacement of the device, such as the map/navigation device shown in FIG. 10*d*. As discussed below, an interrupt command may be issued, and the current image state may be subsequently refreshed, after the GPS module indicates that the location has changed by a threshold amount, such as a change of about 100 feet, for example. The current displayed image may have, for example, eight different image states that the sequence may advance to depending on the direction of the user's movement, where the eight next-in-sequence image states may represent movement in 1) a northerly direction, 2) a northeasterly direction, 3) an easterly direction, 4) a southeasterly direction, 5) a southerly direction, 6) a southwesterly direction, 7) a westerly direction and 8) a northwesterly direction. For example, if the user moves in the easterly direction, then the action taken at step 930 comprises identifying the set of image update data corresponding to an easterly motion of about 100 feet (assuming that the image states in the sequence were created to match motion in increments of about 100 feet). If the unit has moved more than 100 feet, then an aggregate set of images may be identified similarly to the temporal aggregate set of image update data discussed above. After this image has been displayed, there may be eight other image states that may be displayed next depending on the direction the GPS module indicates. Other methods may be utilized for issuing the interrupt command to update the display in a map/navigation device. One such method would be to check a location register about every second, for example. If a new location is contained in the location register then an interrupt command may be issued. The rate of checking the location register may be increased, e.g., to about one tenth of a second, to avoid having the unit move too far as described above. Another method for issuing the interrupt command may link the interrupt timing to the time needed to re-compute the location with the GPS module. The time needed to re-compute the location may vary greatly due to factors such as satellite acquisition or re-acquisition.

Image sequences, created by the process 800 and/or displayed by the process 900, may require less power to be retrieved from memory than a processor would require calculating display update data for displaying a deterministic image sequence. In one embodiment, deterministic image sequences include any sequence that follows a predetermined progression. An example of a predetermined image sequence is a sequence portraying the advancement of time on an analog watch face. FIG. 10*a* illustrates an embodiment of a display device displaying an image representing an analog watch face. The analog watch face displayed in FIG. 10*a* includes a minute hand 505, an hour hand 510, a second hand 515 and a date display 520. Since the motion of an analog watch face follows a predetermined sequence, process 800 can be used to replicate the predetermined motions of the hands 505, 510 and 515. In one embodiment, the second hand 515 rotates at a fixed rate of one clockwise revolution per minute, the minute hand 505 rotates at a fixed rate of one clockwise revolution per hour, and the hour hand 510 rotates at a fixed rate of one clockwise revolution every 12 hours. In the embodiment shown in FIG. 10*a*, the sequence replicating the motion of the hands 505, 510 and 515 will repeat every 12 hours (not including the date window 520). A sequence of images may be created starting at an initial time point and continuing for 12 hours, at which point the sequence may be restarted at the initial time and repeated. The date window may be advanced one day, to Oct. 11 in the example shown in FIG. 10*a*, when the time passes 12:00 am.

FIG. 10*b* illustrates an embodiment of a display device displaying an image representing a digital watch face. This display is another example of a predetermined progression of images. The digital watch face in this example includes a time window 525 that includes the hour, minute and second (two digits each). The watch also includes a date window 530 that includes the month, day and year (two digits each). A sequence of images may replicate the changing of the numbers in the time window 525 such that the second numerals are advanced every second, the minute numerals may be advanced every minute and the hour numerals may be advanced every hour. The date window 530 may be updated when the time passes 12:00 am.

FIG. 10*c* illustrates an embodiment of a display device displaying an image representing a digital watch face in stopwatch mode. This example shows a single time window 535 only. In this exemplary embodiment, time window 535 includes a single number representing elapsed hours, two numbers representing elapsed minutes, two numbers representing elapsed seconds, a tenths of a second number and a hundredth of a second number. These numbers may also follow a predetermined progression that may be created using process 800 and may be displayed using process 900.

FIGS. 10*a*, 10*b* and 10*c* are all example embodiments of displays where the deterministic image sequences follow, at least in part, a predetermined progression of the simplest form. In addition to "predetermined progression" type sequences, deterministic sequences that may be created with process 800 and displayed with process 900 also include sequences that may progress along more than one optional path or direction due to issuance of interrupt commands as discussed above. The stopwatch display shown in FIG. 10*c*, for example, may include a user interface input device 48 shown in FIG. 6*a*. In one embodiment, input device 48 is a button, a switch, a touch-sensitive screen, a pressure- or heat-sensitive membrane that the user may push, thereby issuing an interrupt command to start and/or stop the display sequence. In one embodiment, the stopwatch display sequence may step through each image in the sequence every one-hundredth of a second while the stopwatch is enabled by the user using input device 48. If the user pushes input device 48 while the stopwatch image sequence is running, thus generating another interrupt command, the image sequence may be stopped. In addition to the image sequence displaying increasing time, the sequence may be operated in count down mode where the time being displayed decreases. The stopwatch display shown in FIG. 10*c* is one exemplary embodiment of an image sequence that is not predetermined yet is still deterministic and may be created with process 800 and may be displayed with process 900.

FIG. 10*d* illustrates an embodiment of a display device displaying an image of a map/navigation device. Such a device may have a GPS (global positioning system) module that locates the unit geographically and displays a map. The example shown in FIG. 10*d* includes a unit locator symbol 540 that depicts the location of navigation device relative to $5^{th}$ Avenue 545, $4^{th}$ Avenue 550 and Main Street 555. As the user carrying the navigation device moves across the land represented by the map, the display sequence may be updated to show the changing relative locations of the unit locator symbol 540 and the various roads 540, 545 and 550. The current image may be refreshed after an interrupt command is issued because the GPS module indicates that the location has changed by a threshold amount, such as a change of about 100 feet, for example. The current displayed image may have, for example, eight different images that the sequence may advance to depending on the direction of the user's movement, where the eight next-in-sequence images may represent movement in 1) a northerly direction, 2) a northeasterly direction, 3) an easterly direction, 4) a southeasterly direction, 5) a southerly direction, 6) a southwesterly direction, 7) a westerly direction and 8) a northwesterly direction. If the user moves in the easterly direction, for example, then the unit locator symbol 540 may be rotated to point to the east and be moved a distance representing about 100 feet in the easterly direction. Instead of moving the unit locator symbol 540, the map may be translated 100 feet to the west while keeping the unit locator symbol in the same position of the display, e.g. the center of the display. After this image has been displayed, there may be eight other images that may be displayed next depending on the direction the GPS module indicates the unit has moved at the next received interrupt command. This is another example embodiment of a deterministic sequence of images that does not follow a predetermined path, but may be created using process 800 and may be displayed using process 900.

Figure 11:
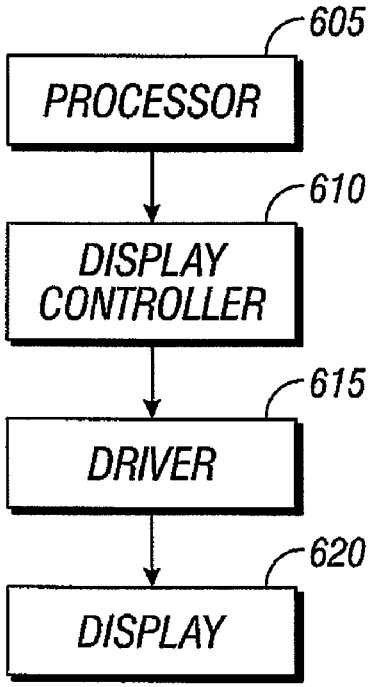
FIG. 11 is a block diagram illustrating a typical configuration of a processor, with a driver controller, a driver and a display.
Figure 12:
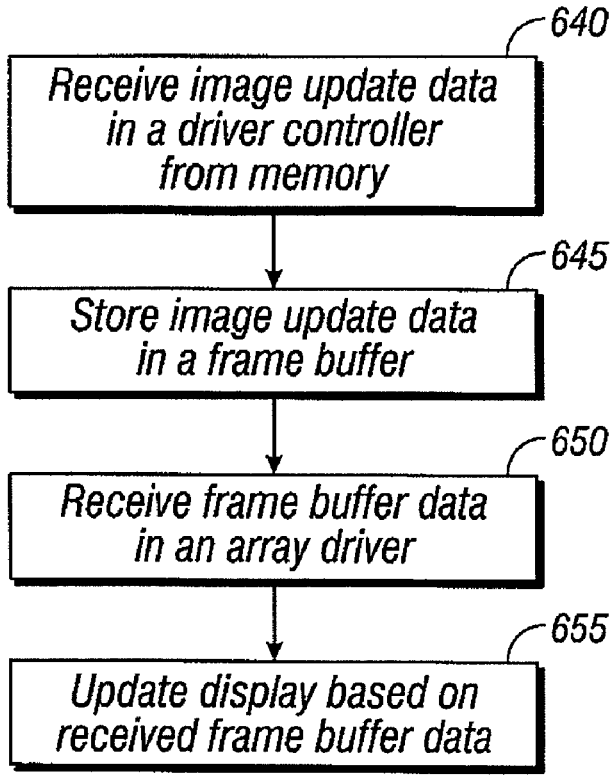
FIG. 12 is a flowchart illustrating an embodiment of a process for displaying an image sequence.

In one embodiment, part or all of process 900 may be implemented in a display device that comprises controllers and/or drivers designed for non-bistable displays where the entire screen is refreshed rather than selective update of individual pixels as in bi-stable displays. Drivers and controllers designed for non-bistable displays may be readily available and may cost less, in the near term, than drivers and controllers designed for bistable displays. In addition, non-bistable displays may cost less than bistable displays, especially in the near term. FIG. 11 shows a block diagram illustrating a typical configuration of a processor, with a display controller, a driver and a display. This embodiment allows the use of an off-the-shelf driver 615 for updating a non-bistable display 620. While updating of the display may not offer a power benefit, since the display is not being selectively updated with the image update data, retrieving stored image update data directly from memory may require less power than would be required to calculate the image update data with processor 605. FIG. 12 shows a flowchart illustrating an embodiment of a process for displaying an image sequence created using the process 800, with the non-bistable display device 620. The steps shown in FIG. 12 replace steps 915 and 920 in process 900 when updating a non-bistable display device as in this embodiment. The other steps in process 900 may remain unchanged when combined with the process shown in FIG. 12. Referencing FIGS. 11 and 12, display controller 610 receives image update data, at step 640, either directly from processor 605, or from memory. The image update data may be similar to that received in step 915 of process 900. Display controller 610 may reformat the image update to a format compatible with driver 615 (step not shown in FIG. 12). Display controller 610 stores the image update data, at step 645, in a frame buffer (frame buffer not shown in FIG. 11, see frame buffer 28 in FIG. 6*b*). The display controller 610 may change only the pixels identified by the image update data when storing the image update data in the frame buffer. Non-bistable display driver 615 receives the updated frame buffer data, at step 650, and updates the non-bistable display 620 at step 655, based on the updated frame buffer data including both the updated and the non-updated data. In this way, stored data created by process 800 may be displayed more efficiently (less power may be required to display the stored image update data created by process 800, than would be required to calculate the image update data in a processor) on devices utilizing less costly drivers and/or controllers designed for non-bistable displays, thereby providing cost and power savings. Other steps in process 900 may be added to the process shown in FIG. 12 and performed using the device as shown in FIG. 11.

An embodiment of a system for displaying image data includes means for bi-stably displaying image data, means for storing a plurality of sets of image update data corresponding to a plurality of images in a sequence of images and wherein the plurality of sets of image update data comprise information identifying pixels to be changed from a previous image in the sequence of images, means for receiving from the storing means one of the stored sets of image update data and the receiving means for updating a portion of the display means, the portion containing the pixels identified in the received set of image update data. With reference to FIG. 6*b*, aspects of this embodiment include where the bi-stably displaying means is display array 30 such as an array of interferometric modulators, where the means for storing comprises memory such as frame buffer 28, and where the receiving means is an array driver 22.

While the above detailed description has shown, described, and pointed out novel features of the invention as applied to various embodiments, it will be understood that various omissions, substitutions, and changes in the form and details of the device or process illustrated may be made by those skilled in the art without departing from the spirit of the invention. As will be recognized, the present invention may be embodied within a form that does not provide all of the features and benefits set forth herein, as some features may be used or practiced separately from others.

What is claimed is:

1. A method of storing image data, the method comprising:

determining image update data to be displayed on a display device comprising an array of bi-stable display elements, the image update data comprising one or more pixel identifiers, each of the pixel identifiers identifying a particular pixel of a first image that differs from a second image in a sequence of images; and storing the image update data in a memory.

2. The method of claim 1 further comprising:

determining, for a third image, a full set of image data identifying all of the pixels in the third image; and storing the full set of image data in the memory.

3. The method of claim 2 wherein determining the full set of image data occurs in response to an interrupt command.

4. The method of claim 1 wherein determining the image update data occurs in response to an interrupt command.

5. The method of claim 1, wherein the image update data excludes identification of pixels of the first image that do not differ from the second image.

6. The method of claim 1, the first image being immediately subsequent to the second image.

7. The method of claim 1, further comprising creating a memory map containing a memory address identifying a location in the memory where the image update data is stored and further containing data identifying the first image at the identifying memory address.

8. The method of claim 1, further comprising run length encoding the image update data prior to storing.

9. The method of claim 1, wherein the sequence of images depicts one of advancing time on a digital watch, advancing time on a digital watch that displays analog-watch-type hand movement, and motion on a map.

10. An apparatus for storing image data, the apparatus comprising:

a processor configured to determine image update data to be displayed on a display device comprising an array of bi-stable display elements, the image update data comprising one or more pixel identifiers, each of the pixel identifiers identifying a particular pixel of a first image that differs from a second image in a sequence of images; and a memory configured to store the image update data.

11. The apparatus of claim 10 wherein the processor is further configured to determine, for a third image, a full set of image data identifying all of the pixels in the third image and wherein the memory is further configured to store the full set of image data.

12. The apparatus of claim 11 wherein the processor is configured to determine the full set of image data in response to an interrupt command.

13. The apparatus of claim 10 wherein the processor is configured to determine the image update data in response to an interrupt command.

14. The apparatus of claim 10, wherein the image update data excludes identification of pixels of the first image that do not differ from the second image.

15. The apparatus of claim 10, the first image being immediately subsequent to the second image.

16. The apparatus of claim 10, wherein the processor is further configured to create a memory map containing a memory address identifying a location in the memory where the image update data is stored and further containing data identifying the first image at the identifying memory address.

17. The apparatus of claim 10, wherein the processor is further configured to run length encode the image update data prior to storing.

18. The apparatus of claim 10, wherein the sequence of images depicts one of advancing time on a digital watch, advancing time on a digital watch that displays analog-watch-type hand movement, and motion on a map.

19. An apparatus for storing image data, the apparatus comprising:

means for determining image update data to be displayed on a display device comprising an array of bi-stable display elements, the image update data comprising one or more pixel identifiers, each of the pixel identifiers identifying a particular pixel of a first image that differs from a second image in a sequence of images; and means for storing the image update data.

20. The apparatus of claim 19 further comprising:

means for determining, for a third image, a full set of image data identifying all of the pixels in the third image; and means for storing the full set of image data.

21. The apparatus of claim 20 wherein the means for determining the full set of image data determines the full set of image data in response to an interrupt command.

22. The apparatus of claim 19 wherein the means for determining the image update data determines the image update data in response to an interrupt command.

23. The apparatus of claim 19, wherein the image update data excludes identification of pixels of the first image that do not differ from the second image.

24. The apparatus of claim 19, the first image being immediately subsequent to the second image.

25. The apparatus of claim 19, further comprising means for creating a memory map containing a memory address identifying a location in the memory where the image update data is stored and further containing data identifying the first image at the identifying memory address.

26. The apparatus of claim 19, further comprising means for run length encoding the image update data prior to storing.

27. The apparatus of claim 19, wherein the sequence of images depicts one of advancing time on a digital watch, advancing time on a digital watch that displays analog-watch-type hand movement, and motion on a map.

28. A computer-readable medium having instructions which, when executed by a processor, cause an apparatus to method of storing image data, the method comprising:

determining image update data to be displayed on a display device comprising an array of bi-stable display elements, the image update data comprising one or more pixel identifiers, each of the pixel identifiers identifying a particular pixel of a first image that differs from a second image in a sequence of images; and storing the image update data in a memory.

29. The computer-readable medium of claim 28, the method further comprising:

determining, for a third image, a full set of image data identifying all of the pixels in the third image; and storing the full set of image data in the memory.

30. The computer-readable medium of claim 29, wherein determining the full set of image data occurs in response to an interrupt command.

31. The computer-readable medium of claim 28 wherein determining the image update data occurs in response to an interrupt command.

32. The computer-readable medium of claim 28, wherein the image update data excludes identification of pixels of the first image that do not differ from the second image.

33. The computer-readable medium of claim 28, the first image being immediately subsequent to the second image.

34. The computer-readable of claim 28, the method further comprising creating a memory map containing a memory address identifying a location in the memory where the image update data is stored and further containing data identifying the first image at the identifying memory address.

35. The computer-readable of claim 28, the method further comprising run length encoding the image update data prior to storing.

36. The computer-readable medium of claim 28, wherein the sequence of images depicts one of advancing time on a digital watch, advancing time on a digital watch that displays analog-watch-type hand movement, and motion on a map.

* * * * *